US008622853B1

(12) United States Patent
Roland

(10) Patent No.: US 8,622,853 B1
(45) Date of Patent: Jan. 7, 2014

(54) GOLF TRAINING DEVICE

(71) Applicant: Scott Roland, Parkland, FL (US)

(72) Inventor: Scott Roland, Parkland, FL (US)

(73) Assignee: Guru Golf, LLC, Coconut Creek, FL (US)

( * ) Notice: Subject to any disclaimer, the term of this patent is extended or adjusted under 35 U.S.C. 154(b) by 0 days.

(21) Appl. No.: 13/659,392

(22) Filed: Oct. 24, 2012

Related U.S. Application Data

(60) Provisional application No. 61/552,027, filed on Oct. 27, 2011.

(51) Int. Cl.
*A63B 57/00* (2006.01)
*A63B 69/36* (2006.01)

(52) U.S. Cl.
USPC ..... 473/398; 473/257; 473/394; 473/400; 473/402

(58) Field of Classification Search
USPC ..... 473/257, 261, 268, 387, 396, 402, 409, 473/394, 398, 400
See application file for complete search history.

(56) References Cited

U.S. PATENT DOCUMENTS

| | | | | |
|---|---|---|---|---|
| 3,114,557 | A * | 12/1963 | Cabot | 473/398 |
| 4,004,814 | A * | 1/1977 | Blair | 473/392 |
| 6,949,033 | B1 * | 9/2005 | Mydland | 473/386 |
| 7,488,263 | B2 * | 2/2009 | Lee | 473/394 |
| 2008/0020868 | A1 * | 1/2008 | Palmer | 473/409 |
| 2010/0075782 | A1 * | 3/2010 | Stiles | 473/386 |

* cited by examiner

*Primary Examiner* — Nini Legesse
(74) *Attorney, Agent, or Firm* — Gold & Rizvi, P.A.; H. John Rizvi

(57) ABSTRACT

A golf training device including a target tee having a ground anchor, a rotating disc, and interchangeable tee heads for providing different tee heights. The interchangeable tee heads are coupled to a resilient member to allow the tee head to pivot and vertically reset itself after repeated impacts from a golf club. The training device includes alignment rods that are releasably attached to the rotating disc to provide golfer stance and body alignment, club face alignment, and ball positioning. The rotating disc is rotated to realign the alignment rods with a new intended target. A T-shaped adaptor is provided to extend alignment rods away from the rotating disc and to assist golfers with putting techniques.

18 Claims, 7 Drawing Sheets

138
100
136
134
130
128
126
132
120
106
122
124
124
122
154
116
118
114
118
112
102
110
108
142
140
122
120
122
106
126
116
114
118
118
115
112
110

GOLF TRAINING DEVICE

FIELD OF THE INVENTION

The present invention relates to golf accessories. More particularly, the present disclosure relates to a golf training device including a target tee having a ground anchor screw, interchangeable tee heads for providing different tee heights, and an adjustable alignment rod system for assisting golfers with stance, body, and club face alignment and golf ball positioning.

BACKGROUND OF THE INVENTION

Golf is a popular sport played by amateurs and professionals alike. The game is typically played on a golf course having nine or eighteen holes where each hole is identified by a marker such as a flag pole. In many communities, golfers often become members of golf clubs that offer particular member services and amenities that cater to individual needs of players. Golf clubs utilize member fees to maintain the playing condition and functional attributes of the golf course. The object of the game is to drive a golf ball into each designated hole with the fewest strokes or shots possible. Each golf hole is assigned a particular stroke or shot definition according to golf rules and regulations. For example, par, birdie, and eagle are all terms that are associated with a particular number of strokes needed to drive a golf ball into a hole. Par is a name given to define a number of shots required to drive a golf ball into a hole. Par 3 means that the golf ball should be driven into a designated hole using only three shots. A birdie means that a golfer was able to drive a golf ball into a hole using one shot under par. The player with the lowest score, the least number of shots needed to make drive a golf ball into a set number of holes, is the winner.

A number of accessories are often used when playing golf. For example, golfers use golf shoes, and a wide variety of golf clubs, such as drivers, irons and putters, which are usually stored in a golf bag. The golf bag may include wheels for rolling the bag along the ground, or the bag may include a strap for carrying on an individual's shoulder. Other articles that are used include gloves and various articles of clothing designed to help shield the player from the sun such as a hat or visor.

One accessory that is often used by golfers is a standard golf tee. Commercial golf tees generally include a shaft having a conical bottom end for inserting into the ground, where the shaft terminates at the top into a shallow cup for holding a golf ball thereon. Golf tees are typically used when initially driving the golf ball from the driving area of the golf course, and also on driving ranges. Golf tees are designed to elevate golf balls off the ground a predetermined distance to provide golfers a heightened striking advantage without obstruction. For example, if a golf ball was simply disposed on the ground, a golfer would often impact the ground with the golf club before coming into contact with the golf ball, thereby hindering the impact force required to drive the golf ball forward. By elevating the golf ball, the path of impact is cleared from obstruction. The traditional golf tees are typically fabricated from wood or plastic and come in a variety of different colors. Golfers often carry golf tees in their pants or shirt pocket, or store them in golf bags.

Conventional golf tees suffer from certain drawbacks. For example, upon impact of the golf club face with the ball, the golf tee typically flies out of the ground. The golf tee is thrown a distance away from the original setting forcing the golfer to locate the tee. The golfer must repeatedly bend over to reset the golf tee, and pick up a dislodged tee over and over again potentially leading to back pain as a result of strain on the individual's back. Some golf tees have been designed to include neon colors or light emitting diodes that visually assist golfers in locating the tee. However, such electronic golf tees often require battery replacement requiring golfers to service the devices. Still another drawback is that most conventional golf tees typically come in standard heights. If a golfer wishes to adjust the height of the ball from the ground, the individual must remove or insert the shaft of the tee from or into the ground to provide a desired height. If the golf tee is removed too far from the ground, the tee will wobble or sway. The prior art has attempted to address this issue by providing a golf tee having a rotationally adjustable unit and a base supporting unit. The height adjustable golf tee includes a plurality of screw threads used to make vertical adjustments. Such units are cumbersome to use, costly, and larger in size. Traditional golf tees are designed for one purpose only and that is to hold a golf ball in place. Such traditional golf tees are not designed to assist golfers in further developing their golfing skills and techniques.

A large variety of training aids are available to help golfers develop their golfing skills and techniques. For example, one training aid includes alignment sticks that are designed to lie on the ground to provide a visual indication to golfers. One problem with such aids is that the alignment sticks cause golfers to misalign their bodies at a target rather than aligning the body parallel to the target. Aiming the toes and body at an intended target, such as a golf hole, can create an "over the top" downswing that can cause poor contact and side spin. Other training aids are complex to assemble, not portable, and time consuming to employ.

SUMMARY OF THE INVENTION

The present invention overcomes the deficiencies of the known art and the problems that remain unsolved by providing a target tee that includes a screw like anchor, rubber friction dampening designed to withstand repeated strikes and automatically reset itself vertically after impact from a golf club, interchangeable tee heads for varying the height of golf balls, and adjustable alignment rod system for training golfers in further developing their golf skills and techniques.

In accordance with one implementation of the present invention, there is provided a target tee comprising;

an anchor including a base having a central orifice, a plurality of posts extending upwards from the base, and a shaft extending downwards from the base;

a bushing sized to fit within the central orifice of the base;

a disc including a central opening, a plurality of slots, and a plurality of threaded openings formed axially within the disc;

a resilient member including a shaft and a first and second member disposed at opposite ends of the shaft;

an interchangeable tee head; and wherein the disc is coupled to the base such that each of said plurality of posts extend through the plurality of slots, and wherein the resilient member is fitted within the central opening of the disc and the bushing such that the second member engages the underside of said bushing and the first member is releasably coupled to the interchangeable tee head.

In an aspect, the anchor further includes a helical member disposed on the outer surface of the shaft to form a screw-like member. The shaft includes a tapered end to be inserted into a hard or soft surface.

In another aspect, each of the plurality of slots is formed to permit the disc to rotate on the base a predetermined amount when the plurality of the posts extend through the slots. Each of the plurality of posts provide a stop to prevent the disc from rotating.

In another aspect, the target tee further includes a plurality of alignment rods where each of the alignment rods includes a threaded end for releasably threading within any one of the threaded openings formed in the disc.

In another aspect, the target tee further includes path rods where the path rods releasably coupled to any of the plurality of alignment rods, via an attachment coupling.

In another aspect, each of the plurality of interchangeable tee heads include longitudinal slots that form an elongated opening, and a plurality of arms joined together at a bottom, the arms include outwardly curved top segments configured to hold a golf ball thereon.

In another aspect, each of the plurality of interchangeable tee heads further includes an elongated hole that is smaller in diameter than the elongated opening, and a stop. The elongated hole is sized to receive the shaft of the resilient member therein such that the first member rests on the stop when each of the plurality of interchangeable tee heads is attached to the resilient member.

In another aspect, the target tee further includes a T-shaped adaptor including a first leg having threaded holes formed at opposite ends of the first leg for receiving the plurality of alignment rods therein, and a second leg including a threaded section for releasably threading within any one of the threaded openings so that alignment rods attached to the first leg are positioned away from the disc a distance defined by the length of the second leg.

In accordance with another implementation of the present invention, there is provided a golf training device comprising;

a circular base including a plurality of posts extending upwards from a top surface of the base, and a central opening;

a conical-shaped leg extending downwards from the underside of the circular base, and a helical member disposed along the conical-shaped leg to form a screw-like member;

a bushing sized to fit within the central opening;

a rotating disc including a plurality of slots formed completely through the rotating disc, a central orifice, and a plurality of threaded holes formed axially within the rotating disc, the rotating disc coupled to the circular base such that the central orifice rotates freely about the bushing and each of said plurality of posts extend through each of the plurality of slots;

a resilient member coupled to the circular base; and an interchangeable tee adapted for holding a golf ball thereon, where the interchangeable tee is coupled to the resilient member such that the interchangeable tee pivots and returns to a vertically oriented position upon each subsequent impact from a golf club.

In one aspect, the interchangeable tee head includes any one of a plurality of interchangeable tee heads, each of the plurality of interchangeable tee heads includes the same height or different heights.

In another aspect, the resilient member includes a rubber nipple coupled to the rotating disc, where each of the plurality of interchangeable tee heads is removeably secured within the rubber nipple.

In accordance with yet another implementation of the present invention, there is provided a method of training a golfer to perfect stance alignment, body alignment and golf club face alignment, said method comprising the steps of:

constructing a target tee comprising:

a circular base including a plurality of posts extending upwards from a top surface of the base, and a central opening;

a conical-shaped leg extending downwards from the underside of the circular base, and a helical member disposed along the conical-shaped leg to form a screw-like member;

a bushing sized to fit within the central opening;

a rotating disc including a plurality of slots formed completely through the rotating disc, a central orifice, and a plurality of threaded holes formed axially within the rotating disc, where the rotating disc is coupled to the circular base such that the central orifice rotates freely about the bushing and each of the plurality of posts extend through each of the plurality of slots;

a resilient member coupled to the circular base; and an interchangeable tee releasably coupled to the resilient member and adapted for holding a golf ball thereon;

selecting and attaching the interchangeable tee to the resilient member;

removably attaching a plurality of alignment rods to the rotating disc;

screwing the target tee into a ground surface;

disposing a golf ball onto the interchangeable tee; and aligning the plurality of alignment rods with an intended target.

In one aspect, the step of selecting and attaching the interchangeable tee includes the step of selecting from a plurality of interchangeable tees having different heights.

In another aspect, the step of aligning the plurality of alignment rods with an intended target includes the step of rotating the rotating disc to reorient the plurality of alignment rods with another intended target to perfect a golfer's stance, body alignment, golf club face alignment, and position of the golf ball.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION OF THE INVENTION

Figures 1, 2:
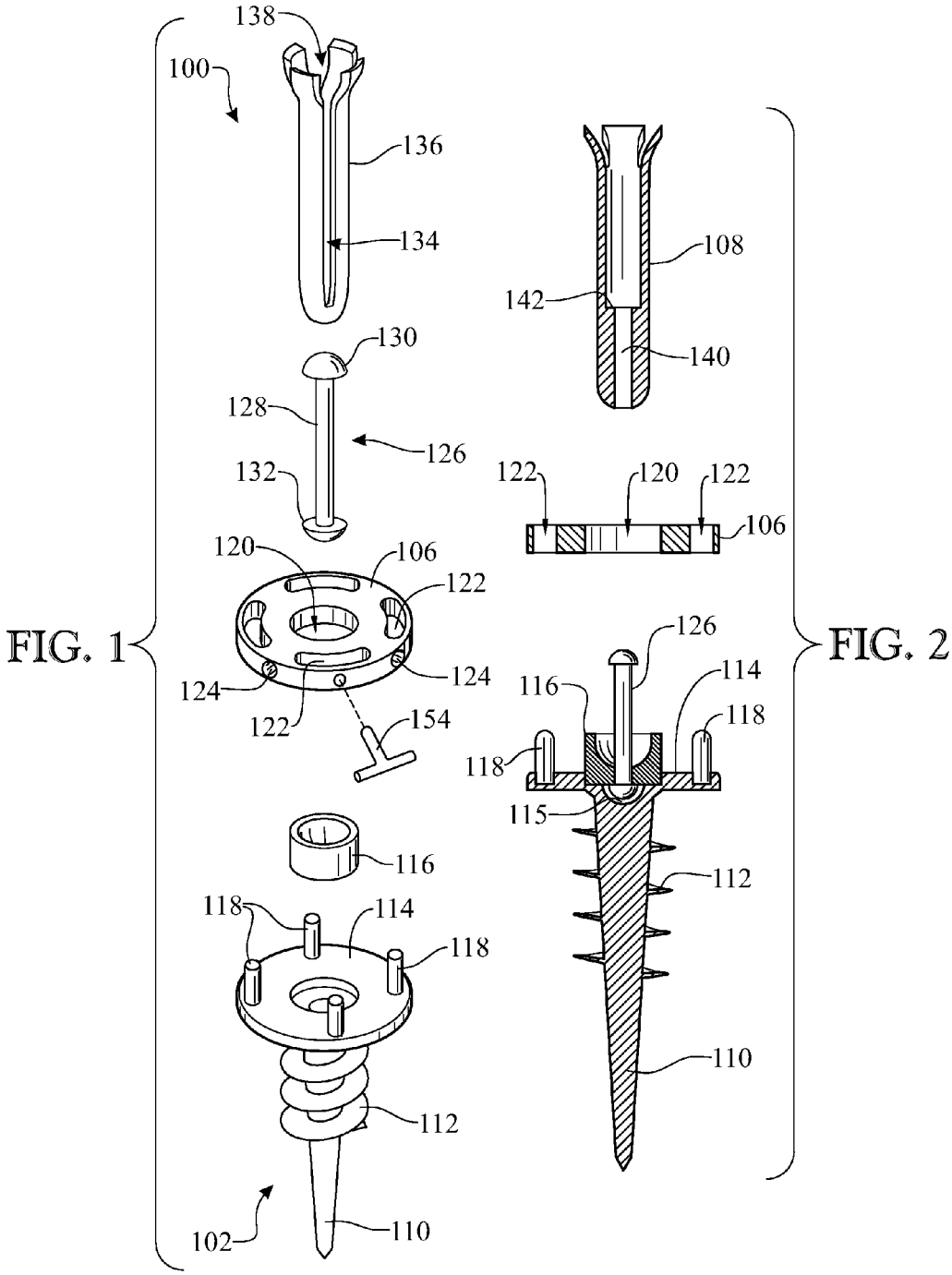
FIG. 1 presents an exploded view of a target tee, in accordance with one embodiment of the present invention.
FIG. 2 presents an exploded cross-sectional view of the target tee of FIG. 1, showing various parts assembled together.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

One embodiment of a target tee 100 is presented in various configurations in the illustrations of FIGS. 1 through 7. Target tee 100 includes an anchoring system defined by a ground anchor 102 that is removably insertable into the ground 104, a rotating disc 106, an interchangeable tee head 108 that is detachably secured to the ground anchor 102 via, a rubber cord 126 to provide a resettable target tee for use in golf, and adjustable alignment rods 148 to assist golfers with stance and club face alignment. A second embodiment of a target tee 200 is presented in FIG. 8 to include a rubber nipple 260 for frictionally holding a standard golf ball holder or tee 262.

Ground anchor 102 includes a shaft 110 having a helical member 112 extending partially downwards along the axial perimeter of the shaft 110 to provide a screw-like arrangement. Like a screw, the helical member 112 is designed to securely hold the target tee 100 firmly in place within the ground 104. In one embodiment, shaft 110 includes a conical-shaped member having a tapered bottom end for easy entry into a surface and a wider top end for providing structural integrity when handling. A golfer may use a common golf shoe spike tool, making it easy for golfers to insert the target tee 100 into any type of turf whether hard or soft. An anchor base 114 is affixed to the top portion of shaft 110. Anchor base 114 includes a hollowed region 115 adapted for partially receiving a bushing 116 and a bottom end 132 of a rubber cord 126. A plurality of upwardly extending posts 118 is disposed on the outer surface of the anchor base 114. It will be understood that the ground anchor system 102 may be fabricated or molded as a single piece from a variety of different materials such as polymer plastics, ceramic, wood, aluminum, or other rust-proof material that able to withstand wear and tear due to use and exposure to the elements. Thus, to help reduce costs and assembly, the shaft 110, helical member 112, anchor base 114 and posts 118 may be fabricated or molded as one unit. Well-known injection molding techniques may be used to construct the device 100.

Target tee 100 further includes a rotating disc 106 having a central hole 120 slightly diametrically larger in size than bushing 116. In assembly, rotating disc 106 is coupled to anchor base 114 with bushing 116 extending through the central hole 120 of disc 106. Bushing 116 provides rotating engagement with disc 106 allowing disc 106 to rotate freely. Hole 120 is diametrically sized to fit snug over bushing 116 preventing the rotating disc 106 from swaying back and forth during rotation. It is contemplated that bushing 116 be replaced with a bearing, rolling bearing, or include a ball bearings to reduce frictional engagement with rotating disc 106 to allow the disc 106 to rotate more freely.

Rotating disc 106 includes a plurality of slots 122 formed within the body of the disc 106 along the outer edge. Each slot 122 is configured to receive a corresponding post 118 there through. Posts 118 aid in coupling and aligning the rotating disc 106 onto anchor base 114, and also serve to limit the rotating angle of disc 106, as described further below. Posts 118 may include nubs, detents, clips or the like to help retain the rotating disc 106 onto anchor base 114. Rotating disc 106 further includes a plurality of threaded holes 124 formed axially within the body of the disc 106. Each threaded hole 124 is dimensioned to receive a threaded end 140 of an alignment rod 148 which is described in greater detail below. The rotating disc 106 and busing 116 may be fabricated from a variety of different materials such as polymer plastics, ceramic, wood, aluminum, brass, or other rust-proof material. The material should be selected to withstand continuous impact by a golf club.

Rotating disc 106 and anchor base 114 may comprise any diametrical shape and size that is selected to provide optimum performance and easy handling during use. In one non-limiting example, rotating disc 106 may be ¼ inch thick to ½ inch thick, and comprise a diameter that is ½ inch to 2 inches. In a preferred embodiment, the diametrical sizes are selected to provide a small yet durable device 100.

With continued reference to FIGS. 1 and 2, target tee 100 also includes a flexible, rubber cord 126 having a cord shaft 128 and a top member 130 and a bottom member 132 disposed on opposite ends of the cord shaft 128. The rubber cord 126 acts as a tension cord that prevents an interchangeable tee head 108 from flying off or breaking upon impact with the face of a golf club. The rubber cord 126 provides rubber friction dampening, and allows tee target 100 to automatically reset the tee head 108 upon subsequent impacts. Rubber cord 126 is designed to extend through central hole 120 of rotating disc 106, and also through bushing 116. As shown in FIG. 2, rubber cord 126 extends through the central hole 120 of disc 106, and bushing 116 such that the enlarged bottom member 132, of the rubber cord 126, is trapped underneath the bushing 116 to rest within the hollow region 115 of anchor base 114. The enlarged top member 130 of the rubber cord 126 is configured to be inserted within the interchangeable tee head 108 to hold the interchangeable tea head 108 in place.

Target tee 100 includes interchangeable tees 108 of varying heights. Each interchangeable tee 108 includes a plurality of longitudinal slots 134 formed within the body of the tee defining a plurality of resilient arms 136 that are joined together at a bottom end 139 and forming an elongated tee orifice having a tee opening 138. The resilient arms 136 are configured to open outwardly to define a golf ball support. In one embodiment of the present invention, each resilient arm 136 includes an outwardly curved top segment to hold a larger surface area of a golf ball. Each curved top segment may be beveled to freely receive the curvature formation of a golf ball when a ball positioned on the tee 108. Alternatively, a friction material may be implemented to frictionally engage with the outer surface of the golf ball to better receive the golf ball without restricting the releasing performance of the golf ball when the ball is stricken by the head of a golf club.

Each interchangeable tee head 108 includes a tee hole 140 that is formed through the tee bottom 139 and axially aligned with the elongated orifice, as better illustrated in FIG. 2. Tee hole 140 is smaller in diametrical size than the elongated orifice resulting in a cord stop 142 for receiving the top enlarged member 130 of rubber cord 126. The top member 130 rests on the cord stop 142 when inserted within tee 108, as better illustrated in FIG. 4.

The rubber cord 126 of the present invention provides the benefit of retaining interchangeable tee heads to the anchor system 102, provides a friction damping system that prevents tee head 108 from flying off or breaking upon impact with the face of a golf club, and forces the tee head 108 to retract to its original position on subsequent impacts.

In assembling target tee 100, bushing 116 is inserted within hollow region 115 of anchor base 114, and rotating disc 106 is inserted onto anchor base 114 so that bushing 116 extends through central hole 120. Posts 118 extend through slots 122 to limit the rotation of the disc 106. Rubber cord 126 is inserted through central hole 120, of disc 106, and bushing 116 such that the bottom enlarged member 132 of rubber cord 126 engages against the underneath of bushing 116 and rests within the hollow region 115 of anchor base 114. The top enlarged member 130 of the rubber cord 126 is inserted in the top opening 138 of the tee head 108 and the shaft 128 slides within a longitudinal slot 134 such that the top member 130 comes to rest on the cord stop 142 to pivotally hold interchangeable tee head 108 onto anchor system 102.

Figure 3:
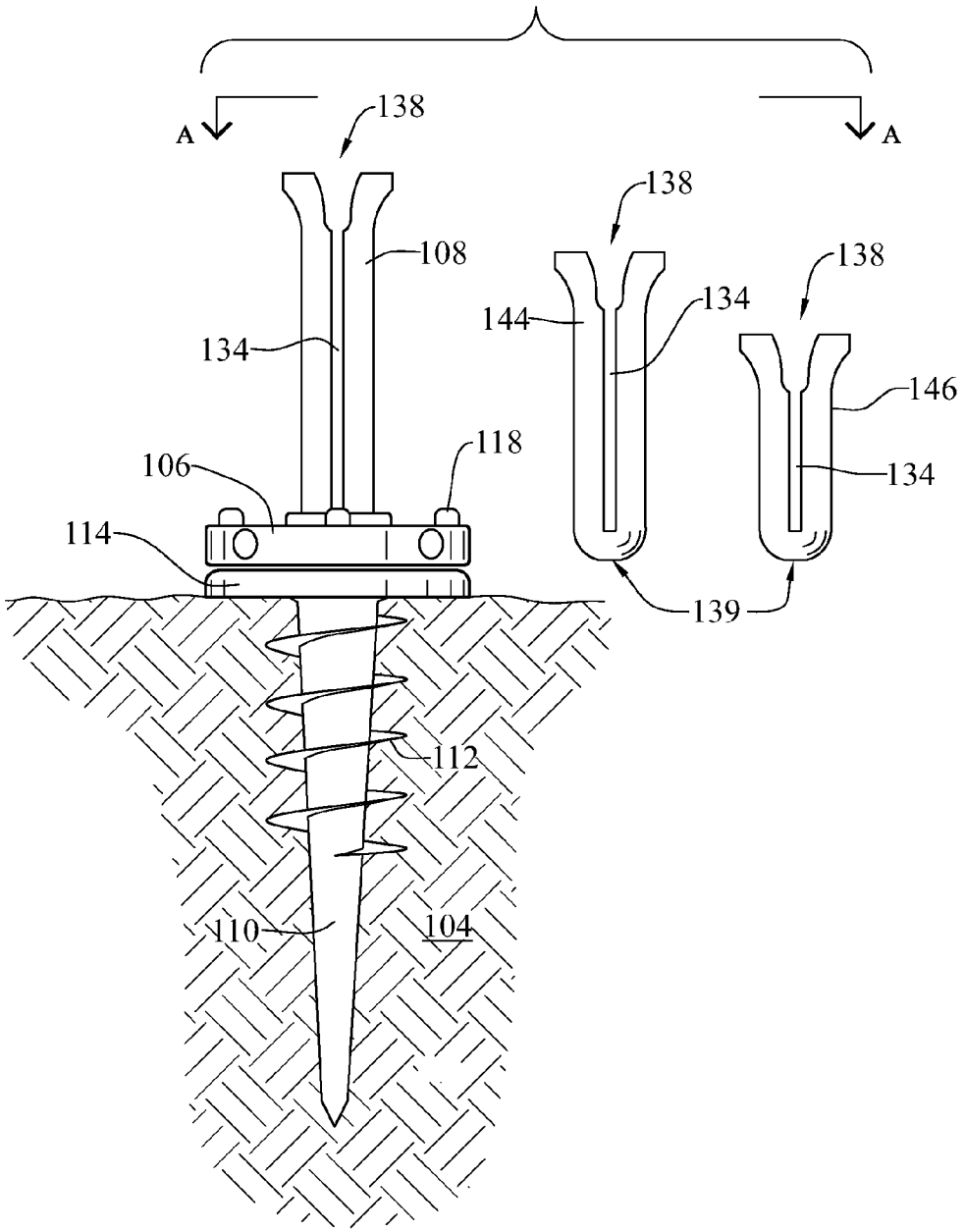
FIG. 3 presents a front, elevational view of the target tee of FIG. 1, showing interchangeable tee heads of different heights, in accordance with the present invention.

As illustrated in FIG. 3, target tee 100 can be firmly inserted into the ground 104 and ready for use, in accordance with the present invention. As noted earlier, a golfer may utilize a common golf shoe spike tool, if desired, to insert the target tee 100 into the ground 104 or can simply rotate the tee 100 by hand like a screw. The helical member 112 rotates within the ground 104 to secure the target tee 100 in place. When fully inserted within the ground 104, the underside of anchor base 114 rests flat on the ground surface. It will be noted that one or more spikes (not shown) may be included on the underside of the anchor base 114 to further secure the target tee 100 in place, if desired.

Advantageously, target tee 100 includes a plurality of interchangeable tee heads 108, 144, 146 designed to provide golfers with ultimate control over tee heights. In the preferred embodiment, each tee head 108, 144, 146 comprise a different height allowing golfers to set golf balls above the ground at various heights. Each tee head 108, 144, 146 includes a longitudinal slot 134 for receiving the shaft 128 of rubber cord 126 to attach the tee head 108, 144, 146 securely to the anchor.

Users must insert traditional golf tees into the ground at various depths in order to provide for adjustable heights making inconvenient and impractical. For example, setting a traditional golf tee higher from the ground compromises the stability of the tee to firmly hold a golf ball in place. The present invention allows target tee 100 to remain firmly in place, while allowing users to interchange tee heads 108, 144, 146. Further, the height of the tee head 108, 144, 146 remains consistent over repeated use. Conventional golf tees do not provide consistent height over repeated use. It is difficult to replace traditional golf tees at the exact depth each time to provide a consistent height.

Figure 4:
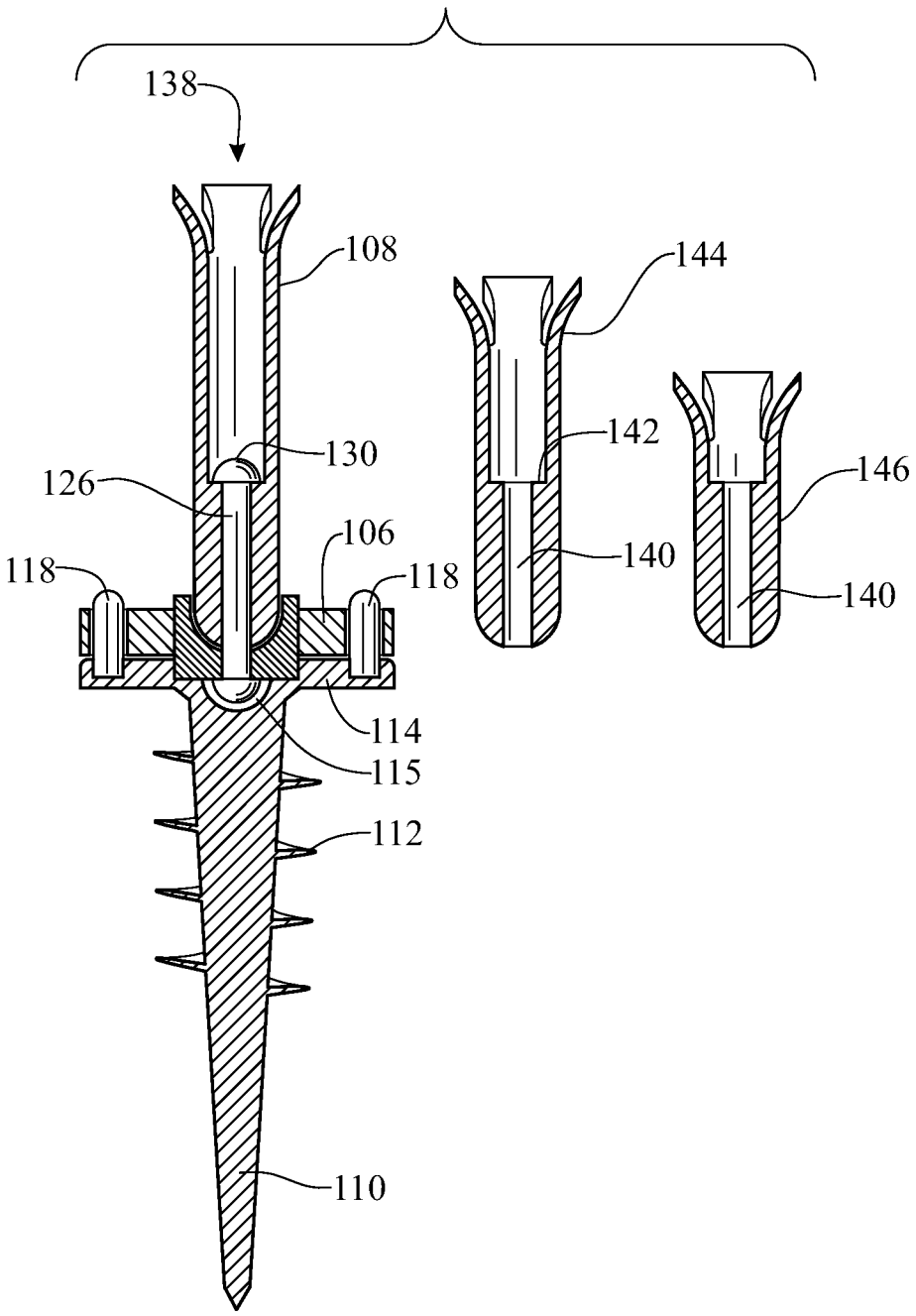
FIG. 4 presents a front, cross-sectional view taken along A-A of FIG. 3.

Turning now to FIG. 4, there is shown a front cross-sectional view of the target tee 100 taken along the A-A line as depicted in FIG. 3. The top enlarged member 130 of the rubber cord 126 is initially inserted within tee opening 138 such that shaft 128, of the cord 126, fits within a longitudinal slot 134, better illustrated in FIG. 3, to allow the top member 130 to come to rest on cord stop 142. The bottom enlarged member 132, of rubber cord 126, butts against the underside of bushing 116 and rests within hollow region 115 of anchor base 114. Tee bottom 139 rests within bushing 116 with posts 118 extending through slots 122 of rotating disc 106. As seen, the length of resilient arms 136 of each tee head 108, 144, 146 differ from one another to provide golf tee heads 108, 144, 146 having different heights. Target tee 100 permits users to easily replace, remove or interchange tee heads 108, 144, 146 with ease.

Figure 5:
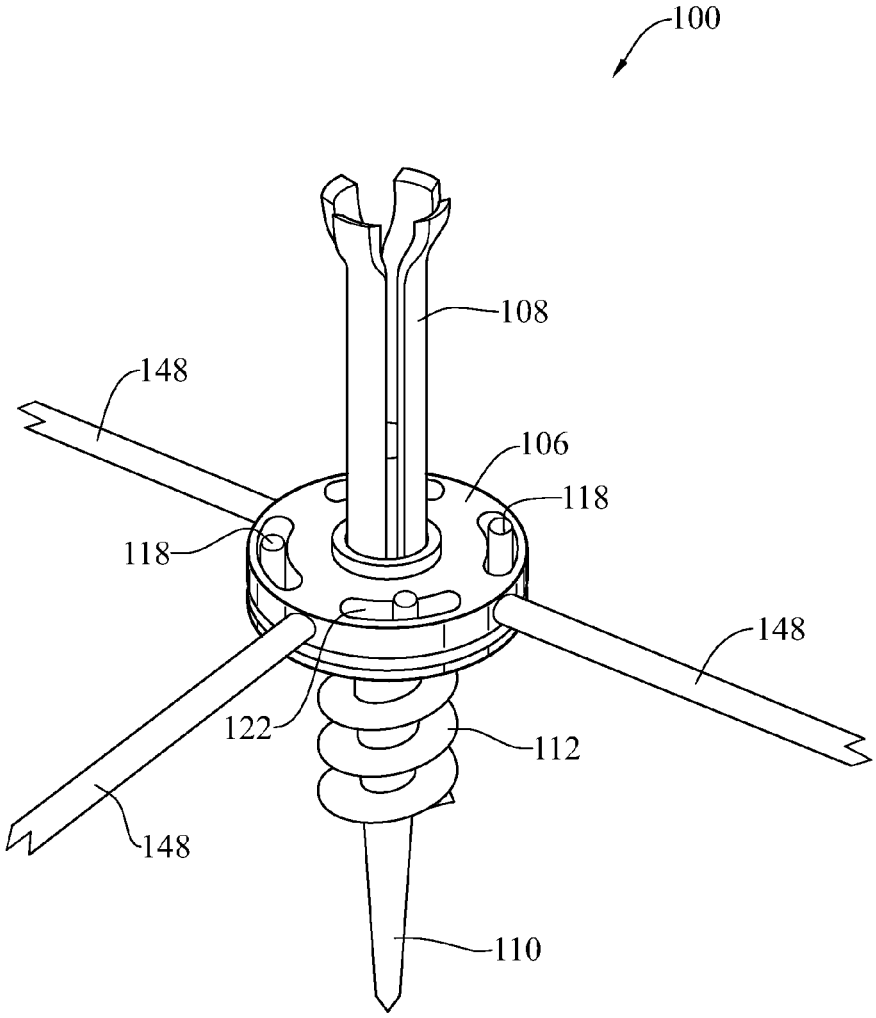
FIG. 5 presents a perspective view of the target tee showing a partial view of alignment rods attached to the target tee, in accordance with the present invention.
Figure 6:
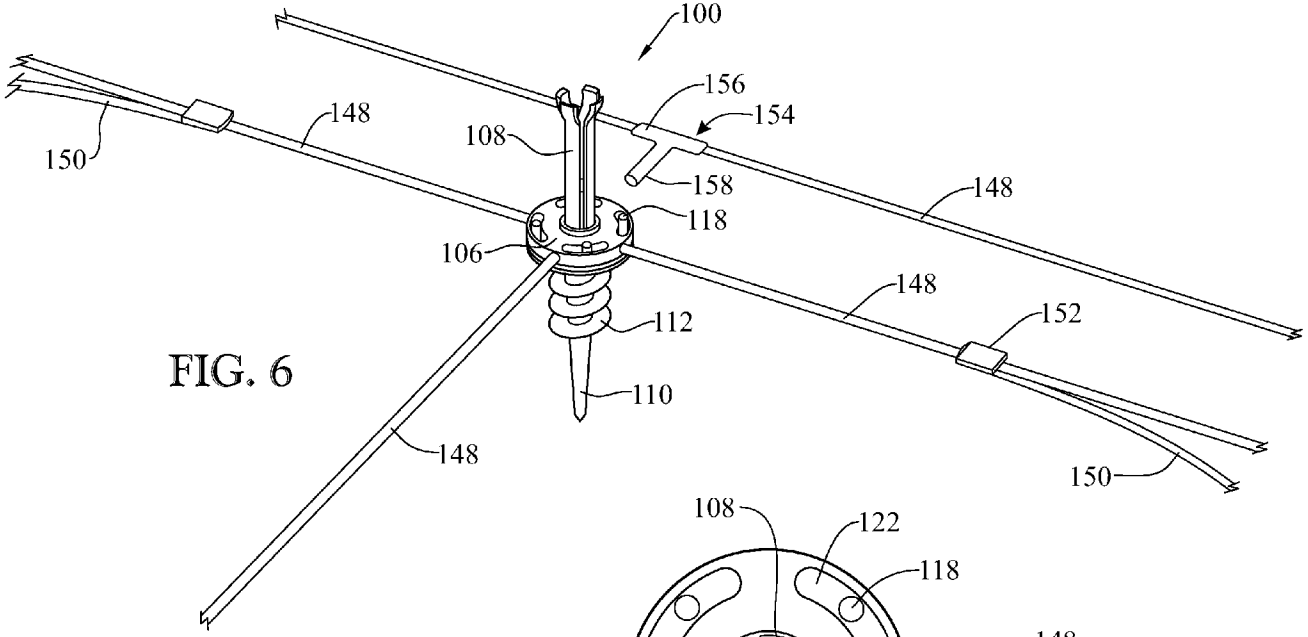
FIG. 6 presents a perspective view of the target tee with alignment rods attached to a rotating disc, and a T-adaptor.
Figure 7:
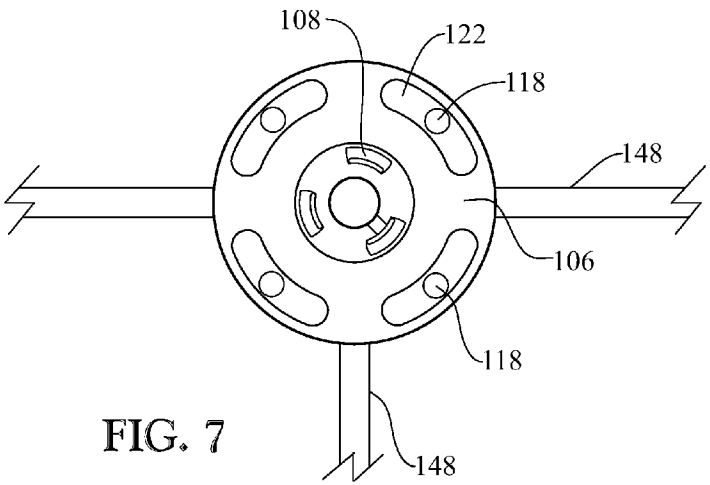
FIG. 7 presents a top view of the target tee showing a partial view of attached alignment rods.

With reference now made to FIGS. 5 and 6, there are shown perspective views of the target tee 100 including an alignment system designed to assist golfers with stance, positioning of shoulders and toes, and club face alignment relative to the position of a golf ball and target location. The alignment system includes a plurality of alignment rods 148, each including a threaded end for removable attachment to threaded holes 124 of the rotating disc 106. In one non-limiting example, alignment rods 148 may comprise 5 inches in length, though other lengths may be implemented as well. Additional alignment rods 148 can be connected to each other via, attachments to increase the length of rods 148, if desired. Also, path rods 150 may be added to one or more alignment rods 148, via coupling 152. The alignment rod system provides options to a golfer for aligning the user's toes and shoulders correctly relative to the position of the golf ball. Alignment rods 148 can be rotated left or right to change location of an intended target without moving the golf training device 100 from place to place. As better illustrated in FIG. 7, posts 118 extend through slots 122 to limit the rotation of rotating disc 106 and positioning of alignment rods 148. Alignment rods 148 provide a visual indication to assist golfers in perfecting their stance and body alignment, provides golf club face alignment, and proper ball positioning.

When fully implemented, a golfer using the target tee 100 will have an anchored base with friction resistant, interchangeable tee heads 108, 144, 146, and the availability of training alignment rods 148 for use with drivers, fairways woods, and hybrid clubs. In exemplary use, when a golfer wishes to use an iron and is ready to hit golf balls, the user can place a golf ball on the grass and secure target tee 100 between the golf ball and golfer's toes. A desired tee height can be quickly selected by choosing one of the interchangeable tee heads 108, 144, 146 and attaching the tee head to base anchor 114, via rubber cord 126. Alignment rods 148 can be implemented to help align a user's toes, shoulders, hips and club face to an intended target. Rotating disc 106 can be rotated with ease to change the positioning of the golfer when moving from one target to another.

As further illustrated in FIG. 6, target tee 100 provides an optional use of a T-shaped adaptor 154. The T-shaped adaptor 154 comprises a first leg 156 integrally formed with and perpendicular to a second leg 158. The distal ends of the first leg 156 each include a threaded bore adapted to threadably receive the threaded ends of alignment rods 148 therein. The distal end of the second leg 158 is also threaded to allow the T-shaped adaptor 154 to be releasably connected to any one of the threaded holes 124 provided within the body of rotating disc 106. In use, adaptor 154 displaces alignment rods 148 away from rotating disc 106 a predetermined distance. As contemplated, the distance is defined by the length of the second leg 158 of the adaptor 154. Adaptor 154 serves two main purposes. First, adaptor 154 allows a golfer to place the cross section of the adaptor 154 out from under the club head starting position. Some golfers prefer to hover or maneuver a golf club head over the ground before swinging, while preparing. Yet other golfers prefer to swing without first hovering. Adaptor 154 is designed for those golfers that prefer to swing immediately the ball without first hovering the golf club head. Adaptor 154 is also useable on putting greens. For example, a popular putting technique in golf includes a method known as "straight back", or "straight through". This method is generally when a golfer moves a golf putter along a straight line back and then forward through impact. When implemented, adaptor 154 acts as a visual guide allowing the golfer to place the golf club head underneath an attached alignment rod 148 to provide a visual indication of a straight stroke path. Thus, a golfer may use target tee 100 along with adaptor 154 to help align and improve putting shots. This is easily accomplished by inserting the target tee 100 into a putting green a slight depth, and releasably threading adaptor 154 into rotating disc 106, via threaded holes 124. Alignment rods 148 can be attached to the distal ends of the first leg 156 of the adaptor 154 to provide an aligned visual indicator that is raised a few inches above the ground. The raised alignment rods 148 act as an alignment aid to also perfect putting skills.

Figure 8:
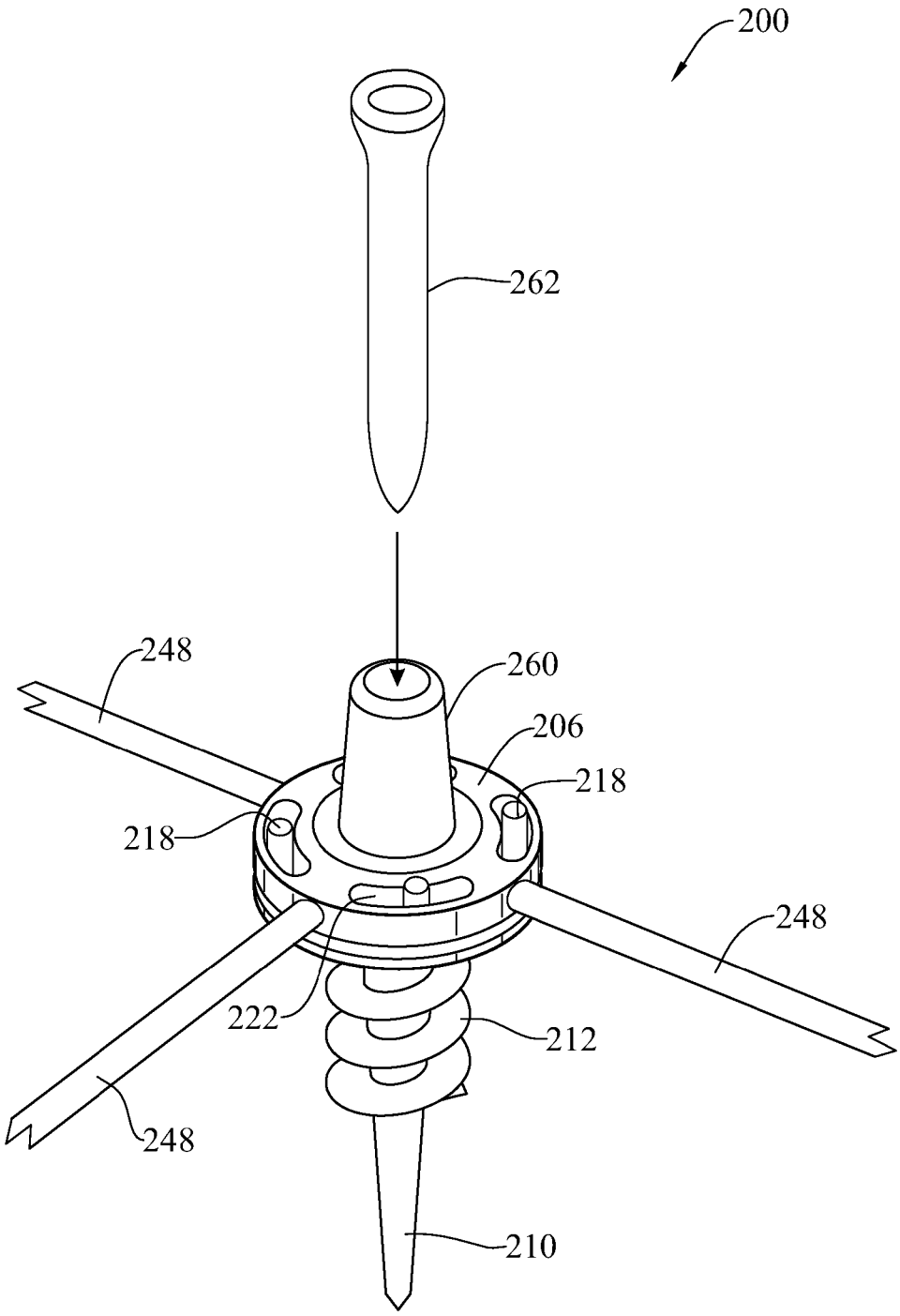
FIG. 8 presents a perspective view of a target tee showing a partial view of alignment rods, and a nipple for holding a standard golf tee, in accordance with another embodiment of the present invention.

A perspective view of a target tee 200 is shown in FIG. 8, in accordance with an alternative embodiment of the present invention. Target tee 200 includes the same features, structures, elements, shapes, and dimensions as that of the embodiment of target tee 100, as shown in FIGS. 1 through 7, with the exception of a rubber nipple 260 and traditional golf ball holder or tee 262. Rubber nipple 260 is designed for frictionally holding a standard golf ball holder 262 therein. The rubber nipple 260 acts similar to rubber cord 126 of FIG. 1, in that the nipple 260 provides friction dampening allowing holder 262 to pivot when struck with the face of a golf club. Target tee 200 provides a benefit of using traditional golf ball holders 262 while providing an automatic resettable golf tee. Golf ball holder 262 can be easily inserted into the rubber nipple 260 with ease. In one exemplary embodiment, rubber nipple 260 may include frictional ridges, grooves or dimples that are formed within the interior surface of the nipple 260 to increase the frictional grip of the standard golf ball holder 262.

The present invention may include alternative embodiments. For example, the conical shaped shaft 102 and helical member 112 of the present invention may be replaced with a spike or spike base configuration. The spike base could house standard rubber golf tees, and alignment rods. The geometrical shapes and sizes of the interchangeable tee heads 108, 144, 146, rotating disc 106, and anchor system 102, and the materials used to fabricate such parts are preferably selected to enhance the structural and functional integrity of the target tee 100, 200 of the present invention. Adapter 154 may include a separate base stand (not shown) that may be connected to the spike base (not shown) forming a free standing unit designed to couple with alignment rods.

The present invention provides a target tee 100 that includes friction dampening to prevent a tee head 108, 144, 146 from flying off when struck by a golf club, provides an automatic tee where the tee head 108, 144, 146 returns upright in a vertical direction in preparation for another strike, includes an alignment rod system that provides visual indication and guidance for proper body alignment, and includes interchangeable tee heads 108, 144, 146 to provide different tee heights. The present invention eliminates the need for golfers to continuously bend over to reposition golf tees after hitting a golf ball, and provides a golf tee that is simple and easy to use.

Figure 9:
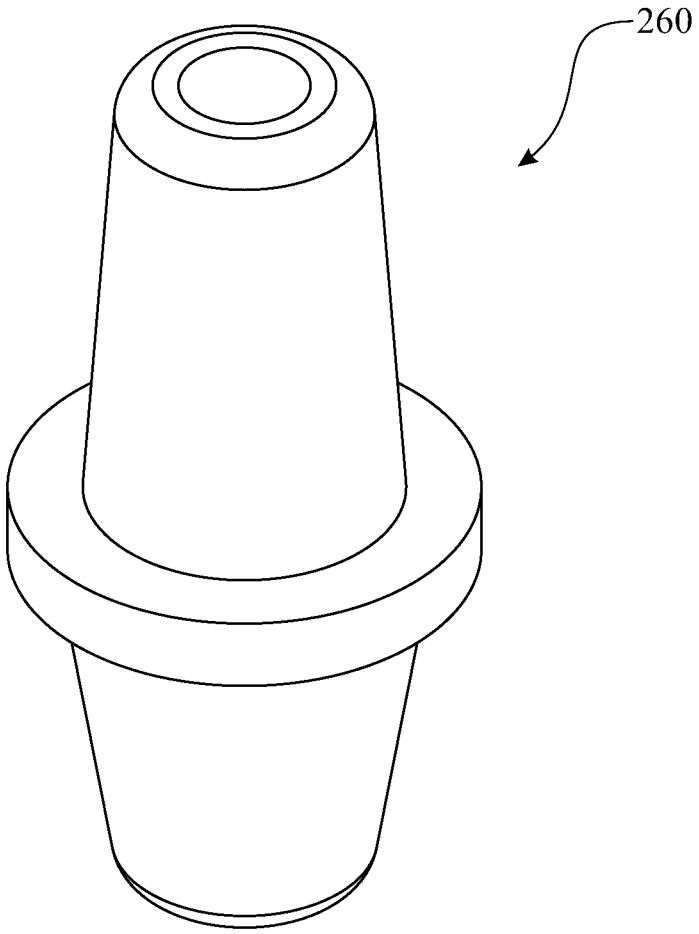
FIG. 9 presents a perspective view of the rubber nipple.

The present invention provides for a recessed tip of the rubber nipple 260 of FIG. 9. A circular ring to determine the depth of insertion into rotating disk 206, and a conical bottom to fit snuggly into the anchor base.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A target tee comprising;

an anchor including a base having a central orifice, a plurality of posts extending upwards from said base, and a shaft extending downwards from said base;

a bushing sized to fit within said central orifice of said base;

a disc including a central opening, a plurality of slots, and a plurality of threaded openings formed axially within said disc;

a removable plastic golf tee; and wherein said disc is coupled to said base such that each of said plurality of posts extend through said plurality of slots, and wherein a rubber nipple is fitted within said central opening of said disc and said bushing so that a second member engages an underside of said bushing and a first member releasably holds a standard plastic golf tee.

2. The target tee of claim 1, wherein said anchor further includes a helical member disposed on an outer surface of said shaft to form a threaded member, said shaft having a tapered end to be inserted into a hard or soft surface.

3. The target tee of claim 2, wherein a diametrical size of said central opening, said central orifice, and said bushing is selected to allow said disc to rotate freely about said bushing when said bushing is disposed within said central orifice of said base.

4. The target tee of claim 3, wherein each of said plurality of slots is formed to permit said disc to rotate on said base a predetermined amount when said plurality of posts extend through said plurality of slots, each of said plurality of posts providing a stop to prevent said disc from rotating.

5. The target tee of claim 4, further including a plurality of interchangeable tee heads, each of said plurality of interchangeable tee heads has a different height.

6. The target tee of claim 5, further including a plurality of alignment rods, each of said plurality of alignment rods having a threaded end for releasably threading within any one of said threaded openings formed in said disc.

7. The target tee of claim 6, further including path rods, said path rods releasably coupled to any of said plurality of alignment rods, via an attachment coupling.

8. The target tee of claim 6, further including a T-shaped adaptor including a first leg having threaded holes formed at opposite ends of said first leg for receiving said plurality of alignment rods therein, and a second leg including a threaded section for releasably threading within any one of said threaded openings so that alignment rods attached to said first leg are positioned away from said disc a distance defined by a length of said second leg.

9. A golf training device comprising;

a circular base including a plurality of posts extending upwards from a top surface of said base, and a central opening;

a conical-shaped leg extending downwards from an underside of said circular base, and a helical member disposed along said conical-shaped leg to form a threaded member;

a bushing sized to fit within said central opening;

a rotating disc including a plurality of slots formed completely through said rotating disc, a central orifice, and a plurality of threaded holes formed axially within said rotating disc, said rotating disc coupled to said circular base such that said central orifice rotates freely about said bushing and each of said plurality of posts extend through each of said plurality of slots;

a resilient member coupled to said circular base; and an interchangeable tee head adapted for holding a golf ball thereon.

10. The golf training device of claim 9, wherein each of said plurality of slots is formed to permit said rotating disc to rotate on said circular base a predetermined amount when said plurality of posts extend through said plurality of slots, each of said plurality of posts providing a stop to prevent said disc from rotating.

11. The golf training device of claim 10, wherein said interchangeable tee head includes any one of a plurality of interchangeable tee heads, each of said plurality of interchangeable tee heads having the same height or different heights.

12. The golf training device of claim 11, wherein said resilient member includes a rubber nipple coupled to said rotating disc.

13. The golf training device of claim 12, wherein each of said plurality of interchangeable tee heads is removably secured within said rubber nipple.

14. The golf training device of claim 13, further including a plurality of alignment rods, each of said plurality of alignment rods having a threaded end for releasably threading within any one of said threaded holes formed in said rotating disc.

15. The golf training device of claim 14, further including a T-shaped adaptor including a first leg having threaded rod holes formed at opposite ends of said first leg for receiving said plurality of alignment rods therein, and a second leg including a threaded section for releasably threading within any one of said threaded holes so that alignment rods attached to said first leg are positioned away from said rotating disc a distance defined by a length of said second leg.

16. A method of training a golfer to perfect stance alignment, body alignment and golf club face alignment, said method comprising the steps of:

constructing a target tee comprising:

a circular base including a plurality of posts extending upwards from a top surface of said base, and a central opening;

a conical-shaped leg extending downwards from an underside of said circular base, and a helical member disposed along said conical-shaped leg to form a threaded member;

a bushing sized to fit within said central opening;

a rotating disc including a plurality of slots formed completely through said rotating disc, a central orifice, and a plurality of threaded holes formed axially within said rotating disc, said rotating disc coupled to said circular base such that said central orifice rotates freely about said bushing and each of said plurality of posts extend through each of said plurality of slots;

a rubber nipple coupled to said circular base; and an interchangeable tee head releasably inserted to said rubber nipple and adapted for holding a golf ball thereon;

removably attaching a plurality of alignment rods to said rotating disc;

screwing said target tee into a ground surface;

disposing a golf ball onto said interchangeable tee head; and aligning said plurality of alignment rods with an intended target.

17. The method of claim 16, wherein the step of selecting and attaching said interchangeable tee head includes the step of selecting from a plurality of available plastic tee's.

18. The method of claim 17, wherein the step of aligning said plurality of alignment rods with an intended target includes the step of rotating said rotating disc to reorient said plurality of alignment rods with another intended target to perfect a golfer's stance, body alignment, golf club face alignment, and position of said golf ball.

* * * * *